US007073577B2

(12) United States Patent
Yu

(10) Patent No.: US 7,073,577 B2
(45) Date of Patent: Jul. 11, 2006

(54) ARRAY OF WELLS WITH CONNECTED PERMEABLE ZONES FOR HYDROCARBON RECOVERY

(75) Inventor: Andrew Dingan Yu, Martinez, GA (US)

(73) Assignee: Applied Geotech, Inc., Martinez, GA (US)

( * ) Notice: Subject to any disclaimer, the term of this patent is extended or adjusted under 35 U.S.C. 154(b) by 154 days.

(21) Appl. No.: 10/652,351

(22) Filed: Aug. 29, 2003

(65) Prior Publication Data

US 2005/0045325 A1 Mar. 3, 2005

(51) Int. Cl.
*E21B 43/30* (2006.01)
*E21B 43/24* (2006.01)

(52) U.S. Cl. ..... 166/245; 166/50; 166/52; 166/272.3; 166/272.7

(58) Field of Classification Search ..... 166/50, 166/272.1, 272.3, 272.7, 52, 303, 305.1, 166/245
See application file for complete search history.

(56) References Cited

U.S. PATENT DOCUMENTS 1,093,031 A * 4/1914 Brown ..... 166/401
1,520,737 A * 12/1924 Wright ..... 166/265
2,365,591 A * 12/1944 Ranney ..... 166/269
2,857,002 A * 10/1958 Pevere et al. ..... 166/303
3,199,587 A * 8/1965 Santourian ..... 166/245
3,358,754 A * 12/1967 Stelzer et al. ..... 166/245
3,386,508 A * 6/1968 Bielstein et al. ..... 166/272.3
4,020,901 A * 5/1977 Pisio et al. ..... 166/50
4,084,637 A 4/1978 Todd
4,257,650 A * 3/1981 Allen ..... 166/272.3
4,296,969 A * 10/1981 Willman ..... 299/2
4,368,781 A 1/1983 Anderson
4,373,585 A 2/1983 Fitch et al.
4,385,662 A 5/1983 Mullins et al.
4,475,592 A 10/1984 Pachovsky
4,598,770 A 7/1986 Shu et al.
4,646,836 A * 3/1987 Goodhart ..... 166/303
4,702,314 A 10/1987 Huang et al.
4,718,485 A 1/1988 Brown et al.
4,754,808 A 7/1988 Harmon et al.
4,874,043 A 10/1989 Joseph et al.
4,889,186 A * 12/1989 Hanson et al. ..... 166/252.1
5,065,821 A 11/1991 Huang et al.
5,273,111 A 12/1993 Brannan et al.
5,299,887 A 4/1994 Ensley
5,320,170 A 6/1994 Huang et al.
5,413,184 A 5/1995 Landers
5,449,889 A 9/1995 Samardzija (Continued)

*Primary Examiner*—Hoang Dang
(74) *Attorney, Agent, or Firm*—Janah & Assoc., P.C.; Ashok Janah; Abigail Cotton

(57) ABSTRACT

Hydrocarbons are recovered from a subterranean reservoir by drilling an injection well bore having an outlet in the reservoir and drilling a production well bore spaced apart from the injection well bore and having an inlet in the reservoir. A permeable zone having a first patterned web of channels radiating outwardly from the outlet of the injection well and connecting to a second patterned web of channels radiating outwardly from the inlet of the production well is formed in the reservoir. Heated fluid is passed from the outlet into the permeable zone to mobilize hydrocarbons in the subterranean reservoir so that the mobilized hydrocarbons flow toward the inlet. The permeable zone fans out from the wells to cover an extended area of the reservoir to enhance hydrocarbon recovery by heating hydrocarbons from an expanded area of a reservoir and gravity draining the hydrocarbons.

22 Claims, 6 Drawing Sheets

U.S. PATENT DOCUMENTS 5,456,315 A 10/1995 Kisman et al.
5,503,226 A 4/1996 Wadleigh
5,607,016 A 3/1997 Butler
6,012,520 A * 1/2000 Yu et al. ..... 166/245
6,561,288 B1 5/2003 Zupanick
6,575,235 B1 6/2003 Zupanick et al.

* cited by examiner

ARRAY OF WELLS WITH CONNECTED PERMEABLE ZONES FOR HYDROCARBON RECOVERY

BACKGROUND

The present invention relates to the recovery of hydrocarbons from a subterranean reservoir.

Hydrocarbons that are recovered from a subterranean reservoir include oil, gases, gas condensates, shale oil and bitumen. To recover a hydrocarbon, such as oil, from a subterranean formation, a well is typically drilled down to the subterranean oil reservoir and the oil is collected at the well head. The recovery of hydrocarbons that are very heavy or dense, such as for example, the recovery of bitumen from oil sands, are especially difficult as these materials are often thick and viscous at reservoir temperatures, so it is even more difficult to extract them from the subterranean reservoir. For example, bitumen can have a viscosity of greater than 100,000 centipoises, which makes it difficult to flow. Suitable methods for the recovery of these heavier viscous hydrocarbons are desirable to increase the world's supply of energy. Methods for recovering bitumen are particular desirable because there are several trillion barrels of bitumen deposits in the world, of which only about 20% or so are recoverable with currently available technology.

A conventional method of recovering hydrocarbons from a subterranean oil reservoir is by utilizing both a production well and an injection well. In this method, a vertical production well is drilled down to a hydrocarbon reservoir, and a vertical injection well is drilled at a region spaced apart from the production well. A fluid is injected into the hydrocarbon reservoir via the injection well, and the fluid promotes the flow of hydrocarbons through the reservoir formation and towards the production well for collection. However, a problem with this method is that the injected fluids tend to find a relatively short and direct path between the injection and production wells, and therefore, bypass a significant amount of oil in the so called "blind spot". Furthermore, if the injected fluid, such as steam, is lighter than the reservoir oil, the injected fluid tends to flow through the upper portion of the reservoir and thus bypass a significant amount of oil at the bottom of the reservoir. Due to these unfavorable mechanisms, injected fluids tend to reach the production well at a relatively early time. When this "early breakthrough" of the fluids occurs, the steam-oil ratio increases rapidly and recovery efficiency of the hydrocarbons is reduced.

In one method of improving the recovery of hydrocarbons using vertical injection and production wells, a horizontal high-permeability web is formed at the bottom of the production well to increase the hydrocarbon recovery area at that region, as described in U.S. Pat. No. 6,012,520, which is incorporated herein by reference in its entirety. The high-permeability web has multiple channels or fracture zones that are formed horizontally about a receiving region of the production well located near the bottom of the reservoir. To recover the hydrocarbons, a neighboring injection well injects steam into a top portion of the reservoir via an injection inlet. The injected steam heats the hydrocarbons in the reservoir, and pushes the hydrocarbons downwards for collection by the high-permeability web of the production well.

However, while this method increases the recovery area immediately about the production well and displaces the oil in a "gravity stable" manner, it's extraction efficiency per unit area is low for subterranean reservoirs having viscous hydrocarbons that are difficult to flow under typical injection pressures. Oil recovery from these reservoirs, such as oil sands reservoirs, remains difficult and yet highly desirable.

In one version of a conventional recovery method, a "huff and puff" process is used to recover bitumen from a subterranean oil sands reservoir. In this method, a vertical well bore is drilled to the reservoir and steam is injected towards the bottom of the bore and into the surrounding reservoir. The steam heats the bitumen about the well bore to reduce its viscosity and cause it to flow back to the well bore. When a desired amount of the bitumen has been collected in the bottom of the well bore, the well is pumped off and the oil is collected at the well head. However, the steam typically traverses only the area immediately around the vicinity of well bore which may be only a small portion of the underground reservoir. Thus the amount of oil recovered is limited by the distance the steam can travel before it cools and condenses, and a large portion of the reservoir may not be reached by steam using this method.

In another conventional method, a Steam Assisted Gravity Drainage (SAGD) process is used to recover bitumen from a subterranean reservoir. In this method, a horizontal production well bore is formed near the bottom of the reservoir. A horizontal steam injection well is formed parallel and above the production well bore. The injected steam heats the bitumen between the wells, as well as above the injection well, and gravitational forces drain the heated bitumen fluids down to the production well for collection. However, this method has problems that are similar to those of the huff and puff method. Namely, after the steam from the injection well reaches the top of the reservoir, the bitumen production becomes limited by the extent to which the steam can laterally expand. As heat losses from the steam to the overburden above the reservoir are high, the lateral expansion is restricted, and a large amount of the reservoir may not be reached by the heated steam.

Thus, it is desirable to efficiently recover hydrocarbons from a large are of a subterranean reservoir. It is furthermore desirable to recover dense or viscous hydrocarbons with injection and production wells that provide a heated fluid to the subterranean reservoir.

SUMMARY

In one method of recovering hydrocarbons from a subterranean reservoir, an injection well bore having an outlet and a spaced apart production well bore having an inlet, are drilled into a subterranean reservoir. A permeable zone is formed in the subterranean reservoir that has a first patterned web of channels radiating outwardly from the outlet of the injection well and connecting to a second patterned web of channels radiating from an inlet of the production well bore. A heated fluid is flowed from the outlet of the injection well into the permeable zone to mobilize hydrocarbons in the subterranean reservoir so that the mobilized hydrocarbons flow toward the inlet of the production well bore.

A version of a well pattern to recover hydrocarbons from a subterranean reservoir has the injection well bore, production well bore, and the permeable zone, and also has an injection fluid supply to supply a heated fluid to the subterranean reservoir to heat the hydrocarbons in the reservoir.

In one version, the injection and production well bores are located at alternating intersection points of a grid pattern. The grid pattern has squares with diagonally facing injection wells bores and diagonally facing production wells bores. The permeable zones are formed to connect facing pairs of outlets of the injection well bores and facing pairs of inlets of the injection well bores in the subterranean region.

In another version, a substantially vertical well bore is drilled into the subterranean reservoir, for huff and puff applications, and a permeable zone having a patterned web of channels is formed that radiates outwardly from the outlet and extends upwardly from the well bore into the subterranean reservoir at an angle of at least about 5 degrees. A heated fluid is flowed into the permeable zone.

A drilling tool to drill a permeable zone has a drill head capable of being inserted into a well bore. The drill head can drill a permeable zone that fans out directly from the well bore at a horizontal angle of from about 30 degrees to about 60 degrees. The drilling tool can comprise powered mechanical drill bits or a high-pressure water jet.

DRAWINGS

These features, aspects, and advantages of the present invention will become better understood with regard to the following description, appended claims, and accompanying drawings, which illustrate examples of the invention. However, it is to be understood that each of the features can be used in the invention in general, not merely in the context of the particular drawings, and the invention includes any combination of these features, where:

DESCRIPTION

The present invention is used to recover hydrocarbons from a subterranean hydrocarbon reservoir 11. The hydrocarbons can be in the form of oil, gas, gas condensate, shale oil and bitumen. The recovery method may be particularly beneficial in the recovery of dense hydrocarbons, such as bitumen.

Figure 1:
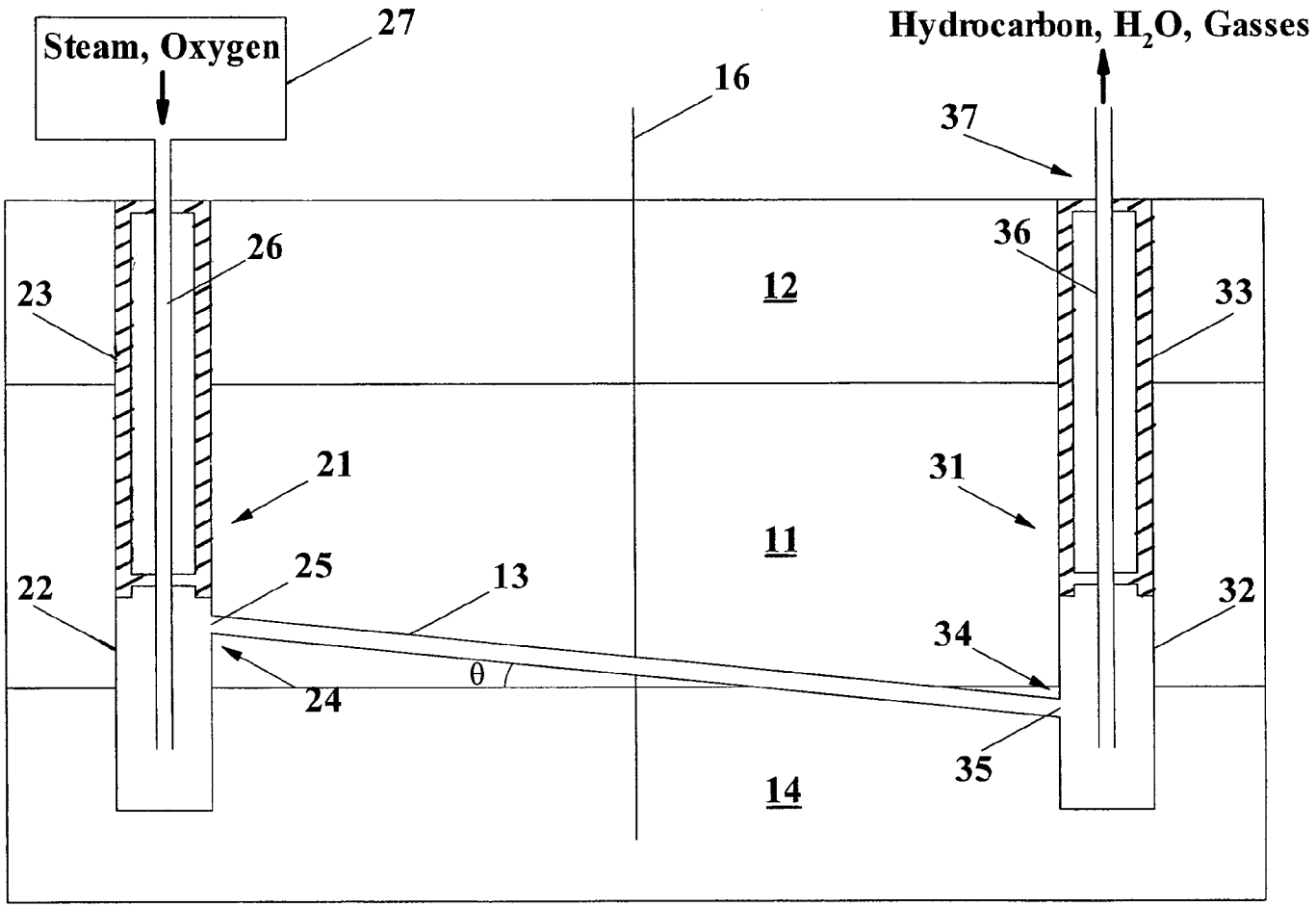
FIG. 1 is a schematic sectional side view of an embodiment of an injection and a production well connected by a permeable zone having a predetermined shape.

To recover hydrocarbons from a subterranean hydrocarbon reservoir 11, a substantially vertical production well 31 is drilled into the ground to receive and recover the hydrocarbons, as shown in FIG. 1. The production well 31 comprises a well bore 32 drilled through one or more overlying layers, such as an overburden 12 to a desired depth in or beneath the subterranean hydrocarbon reservoir 11. A well casing 33 can extend at least partially along the length of the well bore 32 to structurally support the bore 32. The well bore 32 comprises a hydrocarbon receiving zone 34 having one or more receiving inlets 35 in or about the subterranean reservoir 11, the inlets 35 comprising, for example, perforations in the well casing 33, or a portion of the well bore 32 that is otherwise open to the surrounding subterranean formation, such as an open lower end of the well bore 32. The inlets 35 into the well bore 32 are desirably located towards the bottom of and even underneath the hydrocarbon reservoir 11.

Hydrocarbons are collected from the well 31 through a tubing 36 that extends through the well bore 32 to a well head 37 located towards the top of the well bore 32. The hydrocarbons can be lifted through the tubing 36 by natural pressure, induced pressure from injected steams, or with the assistance of a pump (not shown) to pump the hydrocarbons from the bottom of the bore 32 to the well head.

A substantially vertical injection well 21 is provided to inject a fluid into at least a portion of the subterranean reservoir 11 to mobilize and promote the flow of hydrocarbons towards the production well 31. The injection well 21 comprises an injection well bore 22 that is drilled at a location that is spaced apart from the production well 31. The injection well bore 22 can be drilled to a desired depth in or beneath the hydrocarbon reservoir 11, and a well casing 23 can be provided that extends along at least a portion of the bore 22 to structurally support the well bore 22. The injection well bore 22 comprises an injection zone 24 having one or more injection outlets 25 that may be, for example, perforations in the well casing 23 or portions of the well bore that are otherwise open to the surrounding subterranean formation. The injection outlets 25 are desirably located adjacent to the reservoir 11 to provide fluid to the reservoir 11, and may be near the bottom of the reservoir 11.

Typically, a heated fluid is injected by the injection well 21 to heat the hydrocarbons in the reservoir 11, thereby reducing the viscosity of and mobilizing the hydrocarbons so the hydrocarbons flow through the subterranean reservoir 11 towards the receiving zone 34 of the production well 31. For example, the heated fluid can comprise a vaporized liquid such as steam that is supplied by an injection fluid supply 27 such as a steam generator, and injected into the subterranean reservoir 11 via tubing 26. The steam can also be super-heated to provide more thermal energy. As another example, the injected fluid can comprise an oxygen-containing fluid. In this version, an oxygen-containing fluid, such as oxygen gas or air, is supplied by injection fluid supply 27 and is injected into the subterranean reservoir 11 at the injection zone 24. The combustible fluid and reservoir hydrocarbons can be ignited, for example, by lowering an igniter to the injection zone 24. Burning hydrocarbons in the reservoir 11 generates heat that reduces the viscosity of the remaining hydrocarbons. Also, the pyrolysis of the hydrocarbons can decompose heavy hydrocarbons into smaller hydrocarbon molecules that flow more easily to the production well 31, and can also dilute heavier hydrocarbons to promote their flow. The injection fluid may also comprise light hydrocarbons that are easier to ignite to facilitate initiation of the combustion and hydrocarbon burn.

To improve the recovery of the hydrocarbons, a permeable zone 13 is formed to connect the injection and production wells 21, 31. The permeable zone 13 comprises a patterned web of channels 15 in the subterranean reservoir 11 that radiate outwardly from the outlet 25 of the injection well 21 and connect to the inlet 35 of the production well 31. For example, the permeable zone 13 can comprise a first patterned web of channels 17*a* that radiates out from the outlet 25 of the injection well 21 and connects to a second patterned web of channels 17*b* that radiates out from the inlet 35 of the production well 31. The permeable zone 13 having the patterned web of channels 15 increases the flow of hydrocarbons to the production well 31 by providing a highly permeable and accessible pathway in which the hydrocarbons from the reservoir 11 can flow towards the production well 31. The permeable zone 13 also provides an extended heated fluid flow area adjacent to the hydrocarbon reservoir 11 to allow heating of a larger portion of the reservoir 11, and thus, provides for the recovery of a greater number of hydrocarbons from the reservoir 11. For example, as shown in FIG. 1, the permeable zone 13 is formed in a lower section of the subterranean hydrocarbon reservoir 11 such that the hydrocarbons above the permeable zone 13 in the extended region between the injection and production wells 21, 31 are heated by the fluids injected into the permeable zone 13. The heated hydrocarbons in the reservoir 11 above the permeable zone 13 are drained via gravity into the zone 13, in which the heated hydrocarbons flow through to the receiving zone 34 of the connecting production well 31. Thus, the permeable zone 13 provides enhanced heating of an extended area of the hydrocarbon reservoir 11 and improves flow of the heated hydrocarbons to the production well 31 to increase recovery of the hydrocarbons.

The permeable zone 13 can have a patterned web of channels 15 with a predetermined shape that induces a gravity flow of the mobilized hydrocarbons towards the production well 31. For example, the permeable zone 13 can be formed about a plane that is angled downwardly from the injection well bore 22 to the production well bore 32. A suitable angle may be a vertical angle θ, as shown in FIG. 1, of from 0° to about 30°, such as at least about 5°, and even from about 5° to about 20°. To provide a connecting permeable zone 13 having a steeper angle, the injection outlets 25 can be located at positions along the injection well bore 22 that are above the receiving inlets 35 of the production well bore 32. The production well bore 32 can also be drilled into a region below the subterranean reservoir 11, such as in an underburden 14, to provide the desired angle.

Figure 2:
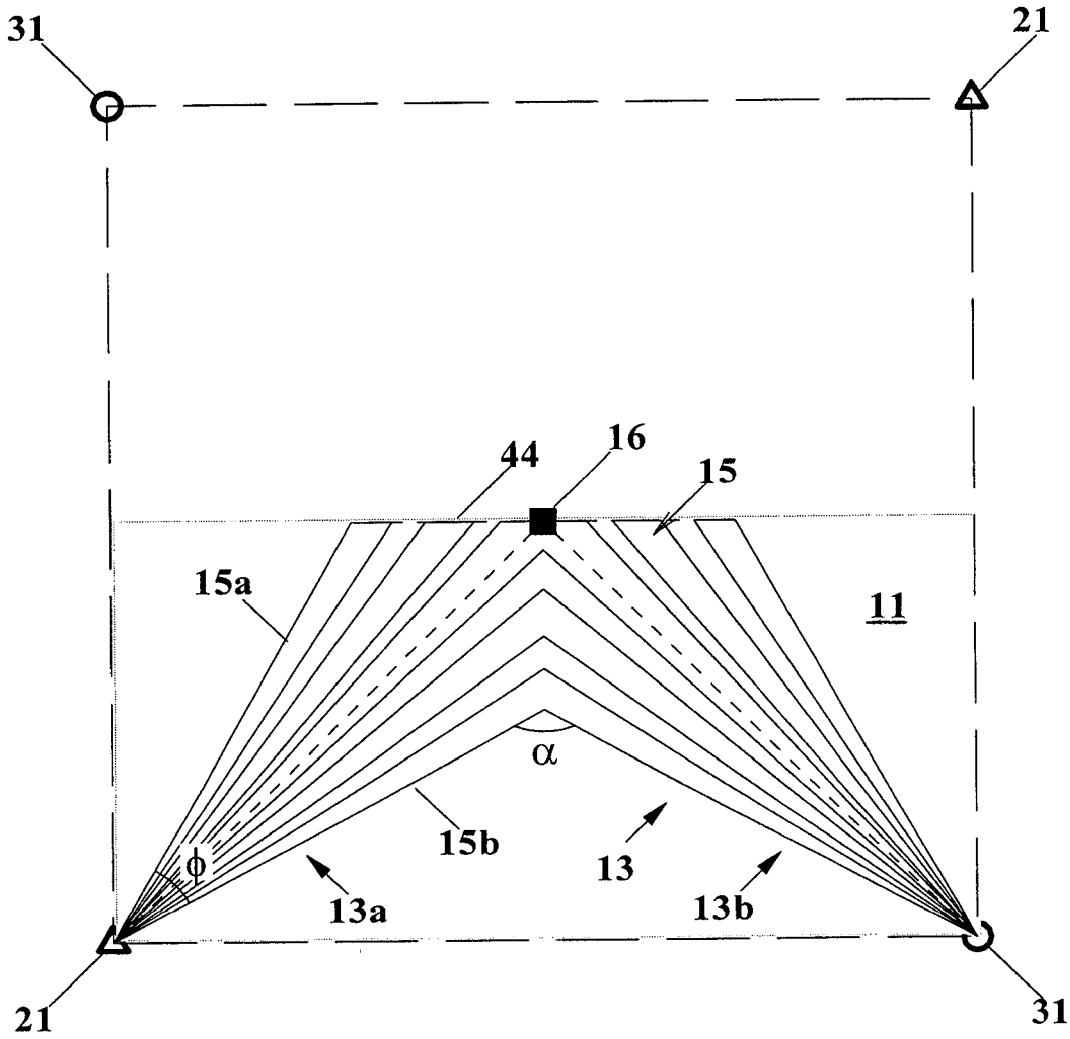
FIG. 2 is a schematic top view of an embodiment of a well pattern showing injection and production wells connected by a permeable zone.
Figure 3:
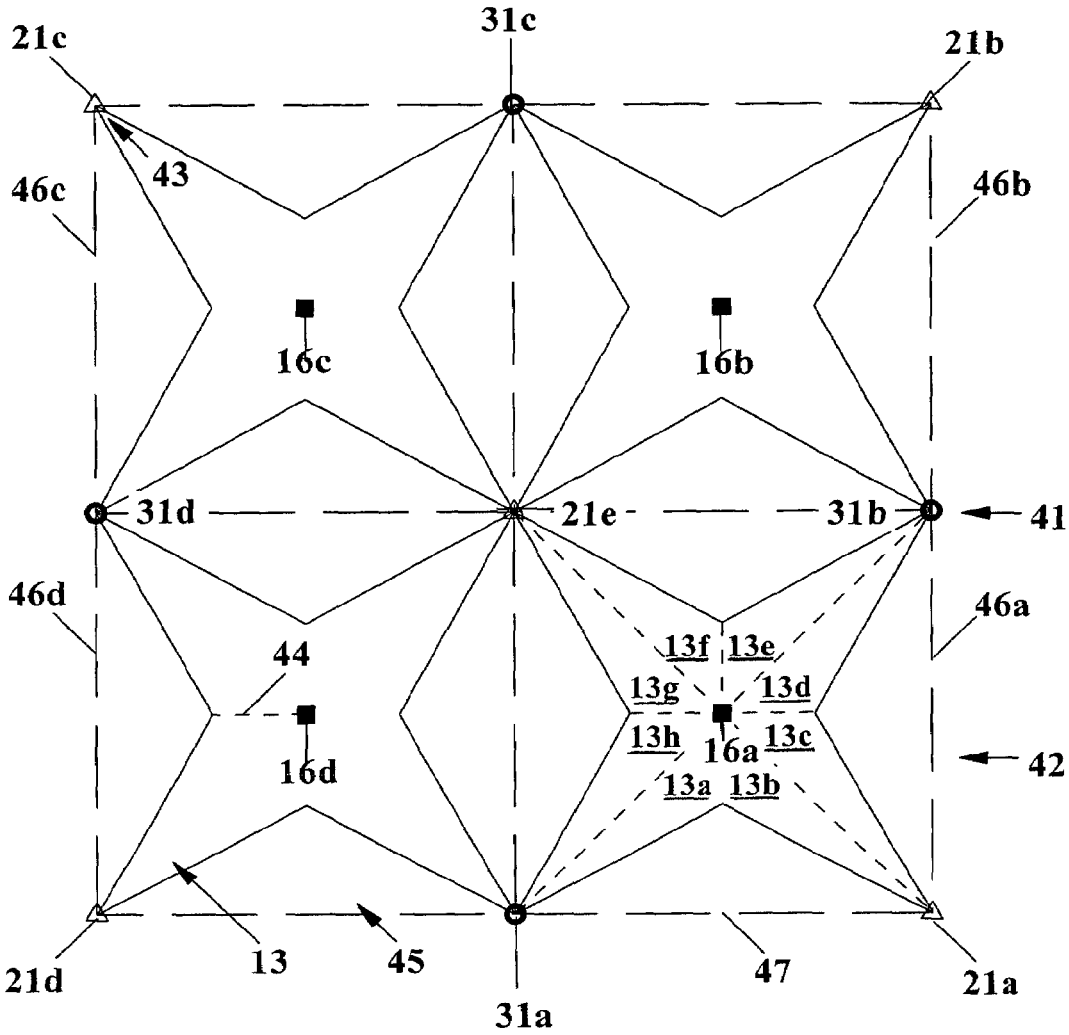
FIG. 3 is a schematic top view of a 5-spot well pattern having injection and production wells connected by a permeable zone.

The permeable zone 13 also desirably fans out from at least one and preferably both of the wells 21, 31 to provide one or more wedge-like shapes that increase in width with increasing distance from the bore to cover a larger area of the reservoir 11, as shown in FIGS. 2 and 3. By forming a zone 13 that radiates out from the bores with increasing width, an increased area of the hydrocarbon reservoir 11 can be heated by the fluid passed through the fluid flow zone 13. For example, the permeable zone 13 can fan out from at least one of the well bores 22, 32 to cover an extended area between the wells 21,31, such as an area about a "blind spot" between the wells. A horizontal angle ϕ carved out by the radiating permeable zone 13, as shown in FIG. 2, may be from about 0° to about 90°, and even from about 30° to about 60°. In one version, as shown in FIGS. 2 and 3, the permeable zone 13 comprises a first radiating section 13*a* having a first patterned web of channels 17*a* connected to the injection well bore 22 of well 21, and a second radiating section 13*b* having a second patterned web of channels 17*b* connected to the production well bore 32 of well 31. The first and second sections 13*a* and 13*b* of the permeable zone 13 are connected together at a point where the sections 13*a*, 13*b* are fairly wide, thus, enhancing heating of the regions between the wells 21, 31.

The permeable zone 13 can also comprise a predetermined shape that connects the injection wells and production wells to form a convoluted and indirect path, such that the permeable zone 13 extends to cover a larger portion of the hydrocarbon reservoir 11. For example, as shown in FIG. 2, the permeable zone 13 can comprise first and second sections 13*a*, 13*b* that are angled with respect to each other such that section 13*a* bisects section 13*b* with a horizontal angle α of from about 90 to about 180 degrees, such as about 90 degrees to about 150 degrees. The vertical angle can be from about 0 to about 30 degrees, such as from example, about 5 to about 20 degrees. This circuitous and indirect route between the injection and production wells 21, 31 allows the fluids flowing in the permeable zone 13 to heat regions of the reservoir 11 that are remote from the wells 21, 31 and that otherwise could be difficult to reach.

The method of recovering hydrocarbons by passing a heated fluid through the permeable zone 13 can be applied to various injection and production well patterns 41. For example, the method of hydrocarbon recovery can be applied to a 5-spot well pattern 41, as shown in FIG. 3. Although the 5-spot well pattern 41 is used as an example, similar principles could be used to apply the recovery method comprising the permeable zone 13 to configurations having only one or two wells, and also configurations having wells in a 4, 7 or 9 spot pattern. In the exemplary 5-spot well pattern 41, alternating production and injection wells 31, 21 are drilled to form an array of wells disposed at the intersection points of an ordered grid pattern 42, for example, with the wells 31, 21 located at the intersection points 43 of the pattern 42. The grid pattern 42 provides extended coverage of a reservoir 11 with multiple hydrocarbon recovery points to increase hydrocarbon production. The intersection points of the grid pattern 42 form one or more squares 46, and each square, such as the first square 46*a*, has the injection and production wells 21*a,e*, 31*a,b* arranged in an alternating fashion at the vertices of the square 46*a* such that the production wells 31*a*, 31*b* lie facing each other along one diagonal of the square and the injection wells 21*a*, 21*e* lie facing each other along the other diagonal. In the version shown in FIG. 3, four squares 46*a–d* having this pattern of injection and production wells 21*a*–21*e*, 31*a*–31*d* are placed together to form the well pattern 41, with one of the injection wells 21*e* forming a common vertex or intersection point 43 of all four squares 46*a–d*.

The pairs of injection wells and production wells in each square 46*a–d* are connected together via one or more permeable zones 13. The wells can be each interconnected to the others via the permeable zone 13, as shown in FIG. 3. Desirably, the permeable zone 13 connects the injection and production wells in each square 46*a*–46*d* in an indirect manner to form a convoluted path therebetween. For example, as shown in FIG. 3, each square 46*a–d* comprises a permeable zone 13 having first through eighth triangular sections 13*a–h*. Each section 13*a–h* fans out with increasing width from a single well 21*a*, 21*e*, 31*a*, 31*b*, and pairs of sections of adjacent injection and productions such as 13*a* and 13*b* abut together along a base 44 of each triangular section about the interior region 16*a* of the square 46*a*, also called the blind spot, to form an interconnected zone 13. Thus, the sections 13*a–h* of the permeable zone 13 form a convoluted and circuitous highly-permeable route to allow the fluids flowing in the permeable zone 13 to reach the interior region 16*a*, and thereby heat even remote regions 16, such as the blind spots.

The permeable zones 13 in each square 46*a–d* form relatively "open" region of the reservoir 11, through which the heated fluid can readily passes, and which are spaced apart from one another in the grid pattern 42 by relatively "closed" and unexcavated regions 45 of the reservoir 11 that remain in the areas of each square 46 where the permeable zone 13 has not been formed. The unexcavated regions 45 are typically in areas where the path between the production well 31 and injection well 21 is relatively short and direct, such as along a side 47 of the square 46*a*. For example, the unexcavated regions 45 can comprise obtuse triangles bounded in each square 46*a* by two sections 13*a,b* of the permeable zone 13 and the side 47 of the square 46*a*. The relatively closed unexcavated regions 45 force the heated fluid to primarily take a more convoluted path between the wells via the permeable zone 13, and thereby sweep out a greater region of the reservoir 11. However, because the distance between the wells in the unexcavated regions 45 is relatively short, the heated fluid gradually seeps into the unexcavated regions 45 and recovers hydrocarbons from these regions as well. Thus, the well pattern 41 having the permeable zones 13 and unexcavated regions 45 of FIG. 3 provides for the recovery of hydrocarbons from a maximized area in the subterranean reservoir 11 by facilitating the flow of heated fluid to remote or hard to reach areas and controlling a flow of the heated fluid to the more easily accessible areas. This novel configuration prevents the steam from initially taking the shortest path between the outlet of the injection well and the inlet of production well, and instead forces the steam to access a larger area between the wells. At the same time, it allows hydrocarbons in the closed regions to be gradually swept as the open regions expand into them. Thus, the array of wells in a grid pattern with permeable zones therebetween efficiently recovers hydrocarbons from the subterranean region.

Figure 4:
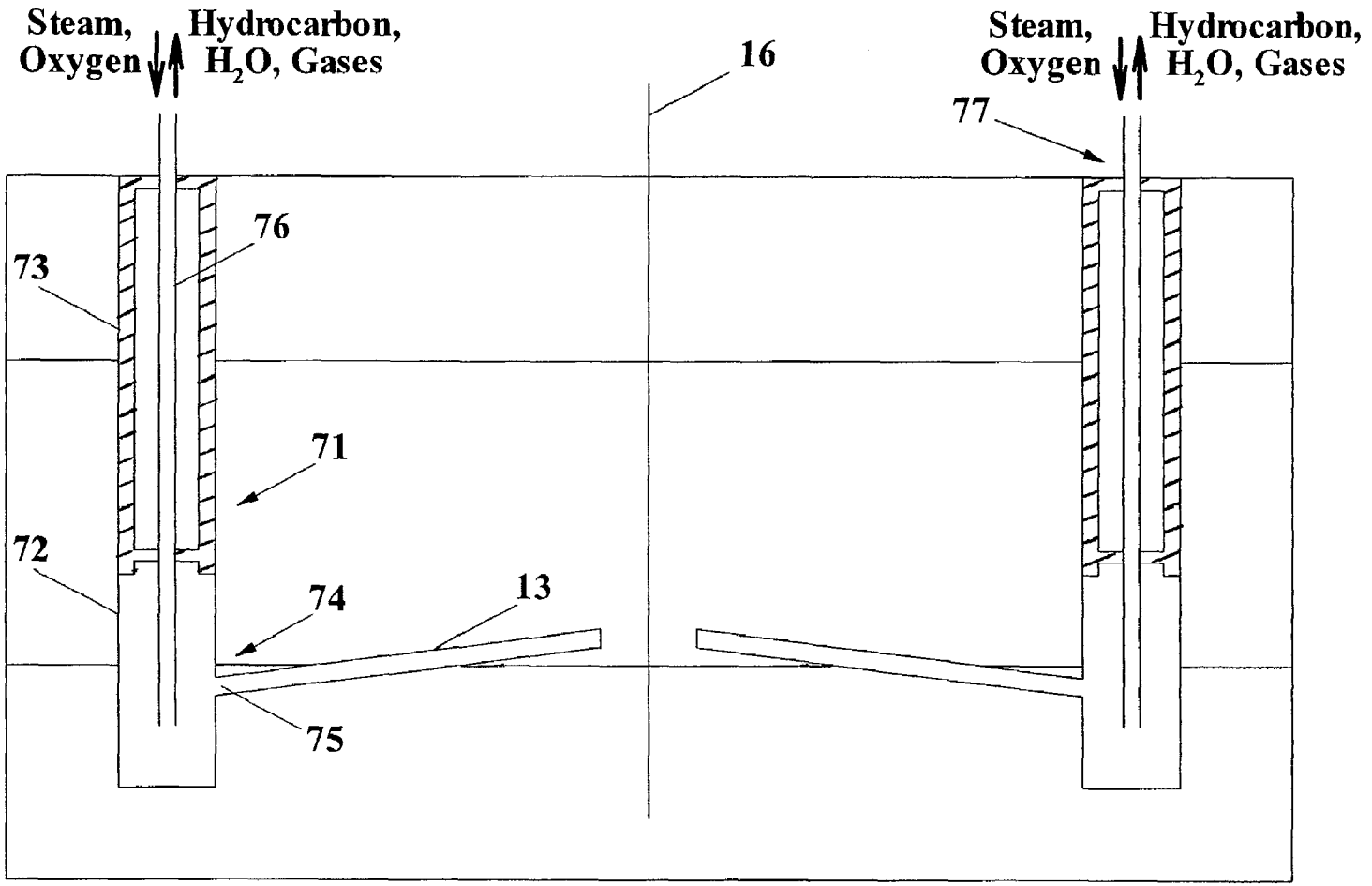
FIG. 4 is a schematic sectional side view of another embodiment of a well having a permeable zone.

In another version, which can be applied, for example, to a "huff and puff" process, a well 71 is setup to operate as both an injection and production well, as shown in FIG. 4. The well 71 comprises a well bore 72, such as a substantially vertical well bore 72, that extends into the subterranean hydrocarbon reservoir 11. The well 71 can comprise a well casing 73 and a tubing 76 through which fluids such as steam, oxygen, other gases and hydrocarbons, are flowed. A permeable zone 13 having a predetermined shape is formed that extends upwardly from an injection outlet 75 in an injection and receiving zone 74 of the well bore 72 into the subterranean hydrocarbon reservoir 11. A suitable vertical angle of the permeable zone 13 may be at least about 5°, such as from about 5° to about 30°, and even from about 10° to about 20°. In operation, heated fluids, such as for example steam or oxygen-containing gases, are introduced into the permeable zone 13 via the injection outlet 75. The heated fluids are "shut in" the well 71, to allow heating of the hydrocarbons above the permeable zone 13. The heated hydrocarbons flow into the permeable zone 13 and drain via gravitational forces along the angled zone 13 into the injection and receiving zone 74 of the well bore 72. Once a sufficient volume of hydrocarbons has been collected in the bottom of the well bore 72, the hydrocarbons are produced to a well head 77 of the well 31, for example by pumping off the well 71, to allow recovery of the hydrocarbons. The method allows for an extended region of the subterranean reservoir 11 about the well bore 72 to be heated, thereby increasing the recovery of the hydrocarbons from the reservoir 11.

Methods of forming the permeable zone 13 include, for example, high-power microwave irradiation, high-pressure water jet drilling, mechanical drilling, explosive fracturing, hydraulic fracturing and drilling with lasers. In one version of a microwave irradiation method, a microwave irradiation device such as a high-power microwave antenna is lowered into one or more of the production and injection well bores 32, 22. The microwave irradiation device generates microwave beams that irradiate regions of the subterranean reservoir 11 adjacent to the well bore, and the water in the irradiated regions is quickly vaporized by the microwave energy. This rapid generation of large amounts of water vapor induces fractures in the regions irradiated by the microwave beams, causing increases in the permeability of the irradiated region and thereby forming a highly permeable zone 13 comprising a patterned web of channels 15 radiating out from the well bore. The frequencies, directions, intensities, angles and durations of the microwave beams are selected to provide desired characteristics of the permeable zone 13, such as the desired predetermined shape, including the direction and angle of the permeable zone 13, and the desired permeability of the zone 13. A suitable permeability of the irradiated region, and thus the permeable zone 13, is for example more than about one Darcy. Multiple radiating permeable zones 13 can also be provided by irradiating the subterranean reservoir 11 from the bore in multiple different directions, for example to connect wells in adjacent 5-spot patterns. Microwave methods of irradiation are described in U.S. Pat. No. 5,299,887 to Ensley et al, herein incorporated by reference in its entirety and U.S. Pat. No. 6,012,520 to Yu et al., herein incorporated by reference in its entirety.

The permeable zone 13 can also be formed by at least one of a mechanical and a high pressure water jet drilling method. Methods of drilling with a high pressure water jet drill are described in U.S. Pat. No. 5,413,184 to Landers et al., and U.S. Pat. No. 6,012,520 to Yu et al., both of which are herein incorporated by reference in their entireties. In a method of drilling the permeable zone 13, a drilling tool is lowered into one or more of the injection well bore 22 and the production well bore 32. The drilling tool drills multiple channels 15 radiating out from the well bores 22, 32, to form a permeable zone 13 having a patterned web of channels, as shown for example in FIGS. 2 and 3. The multiple channels 15 provide a highly permeable and extended area into which the hydrocarbons and fluids can flow.

The multiple channels 15 of the patterned web can be formed in the predetermined shape, for example upwardly or downwardly angled, and can also be formed such that a horizontal angle $\phi$ formed between outermost channels 15*a*, 15*b* is from about 0° to about 90°, and even from about 30° to about 60°. The multiple channels 15 are desirably large enough to provide a good flow of hydrocarbons and fluids through the channels 15, while remaining small enough such that the portions of the reservoir 11 above the permeable zone 13 are not destabilized. A suitable thickness of a channel 15 may be, for example, from about 1 inch to about 12 inches, such as from about 2 inches to about 6 inches.

Figure 5:
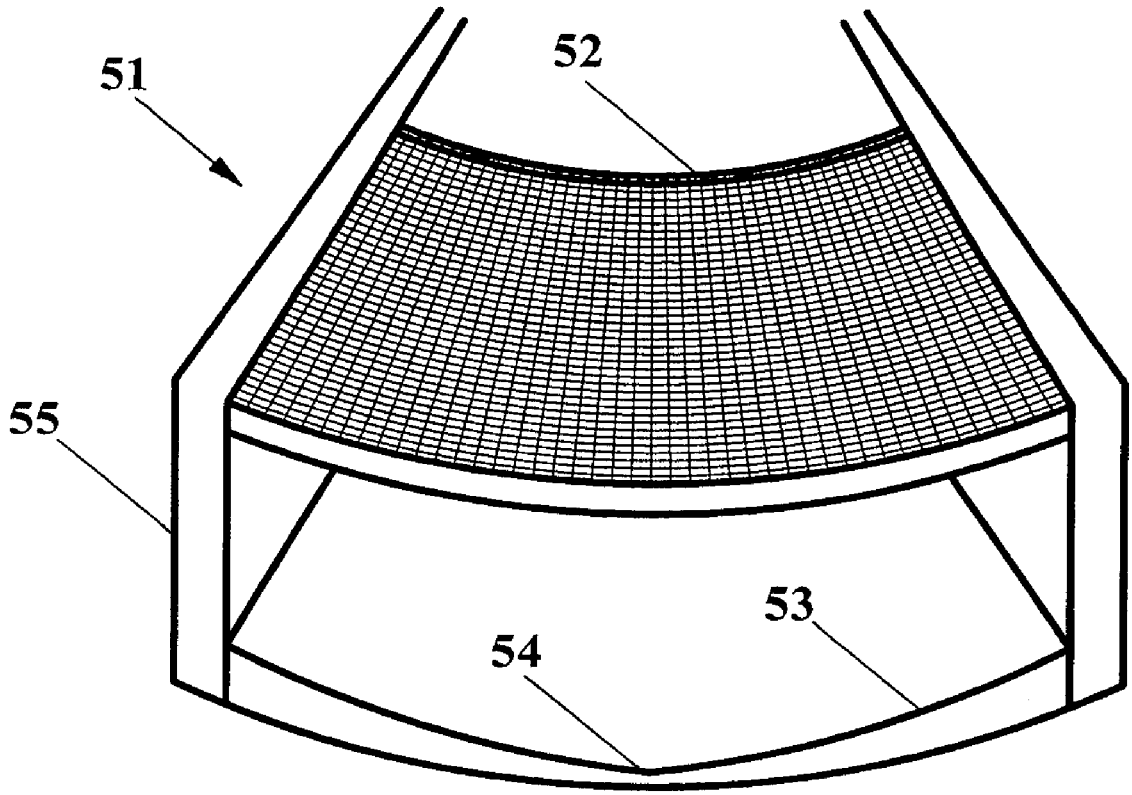
FIG. 5 is a schematic sectional side view of an embodiment of a channel having a porous liner.

The channels 15 can further be stabilized by providing a liner 51 about at least a portion of the channel 15, as shown for example in FIG. 5. The liner 51 may be desirable as the drilling and depletion of the hydrocarbons can lead to unstable conditions in the subterranean reservoir 11. The liners 51 can be inserted into the channel 15 by lowering the liner 51 into the well bore and extending the liner from the well bore into the channel 15. The liner 51 comprises a top section 52 that is permeable to the hydrocarbons and fluids, for example the top section 52 can comprise a permeable material such as a highly porous net, a flexible plastic sheet with holes or a synthetic porous media. A bottom section 53 of the liner 51 is shaped to improve the fluid flow through the channel 15, for example, the bottom section 53 can comprise a substantially impermeable and flexible plastic sheet with a groove 54 to facilitate gravity drainage of the fluids. The two sections 52 and 53 are separated by spaced apart braces 55 that provide structural support for the liner 51 and channel 15.

Figure 6:
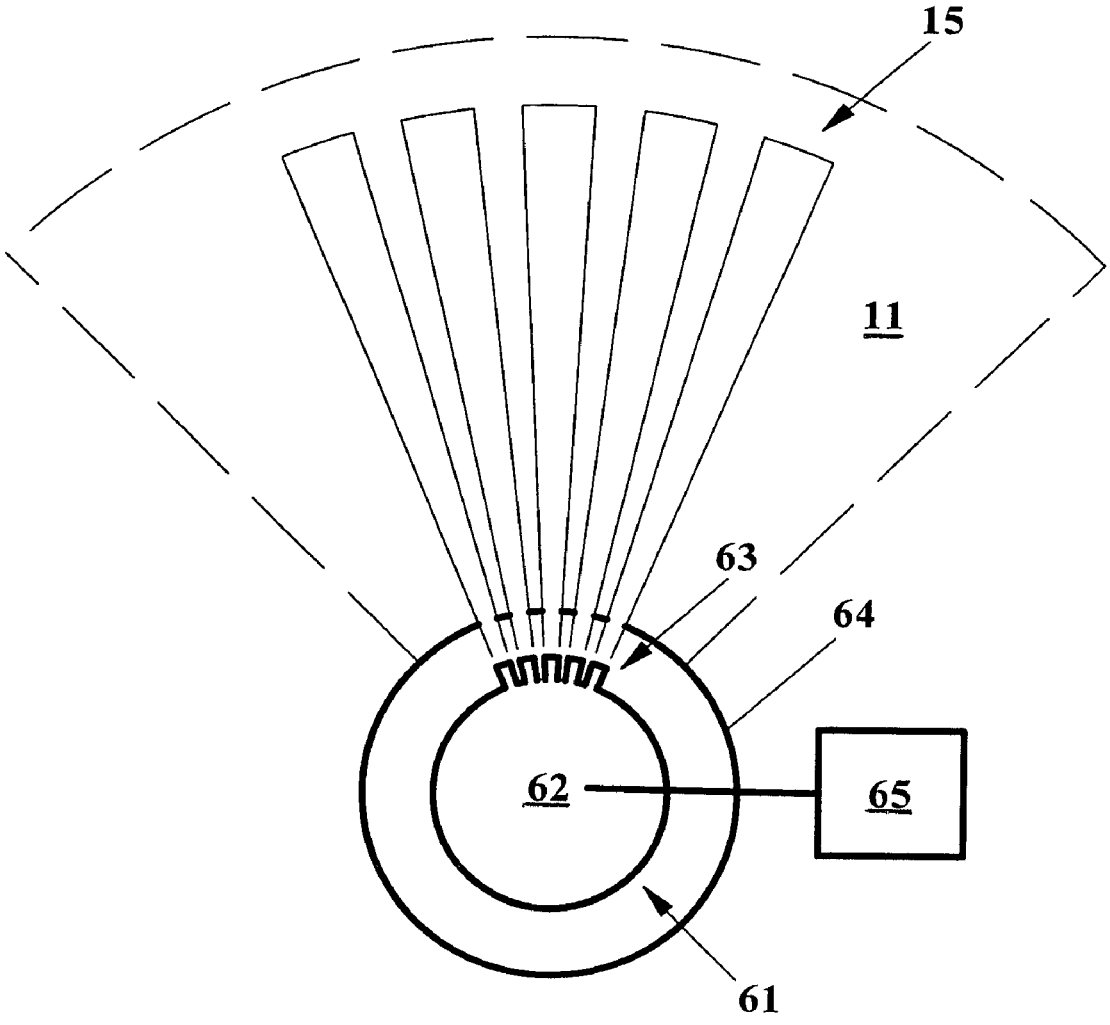
FIG. 6 is a schematic top view of a drilling tool adapted to drill multiple conduits to form a permeable zone having a predetermined shape.

An example of a drilling tool 61 suitable for forming the permeable zone 13 is shown in FIG. 6. The drilling tool 61 comprises a drill head 62 that is capable of being inserted into the well bores 22, 32 and positioned adjacent to the injection zone 24 or receiving zone 34. The drill head 62 is adapted to drill a permeable zone 13 having the desired predetermined shape, such as a permeable zone 13 that fans out from the well bore 22, 32 at a horizontal angle of from about 30 degrees to about 60 degrees. The drill head 62 can also be adapted to drill a permeable zone 13 that is angled upwardly or downwardly at an angle of at least about 5 degrees. In one version, the drill head 62 comprises multiple high-pressure water jet nozzles 63 that are positioned to simultaneously drill multiple channels 15 along a predetermined arc of a bore wall 64 by shooting high-pressure water jets at predetermined points along the arc. In another version, the drill head 62 comprises multiple rotating drilling bits 63 that are adapted to simultaneously drill the multiple channels 15 along the arc in the bore wall 64 to form the permeable zone 13 having the predetermined shape. A drilling tool power source 65 supplies power to the drill head 62 to drill the channels 15.

EXAMPLE

The following example demonstrates the advantageous process economics of bitumen recovery using a 5-spot well pattern having the permeable zone 13. In this example, the estimated total reservoir volume within a pattern region that is 25 meters thick and with a distance of about 330 feet between adjacent injection and production wells, as is typical for oil sands in Alberta Canada, is 330 ft×330 ft×25 m×3.28 ft/m=$9\times10^6$ $ft^3$. The bitumen content is typically 25% by volume of the reservoir region, or $2.2\times10^6$ $ft^3$ or $4\times10^5$ bbl. The heat of combustion of the bitumen is 19,000 BTU/lb and the density of the bitumen is 62 $lb/ft^3$. Thus, the total heat content of the bitumen in a pattern=19000 BTU/lb×62 $lb/ft^3\times2.2\times10^6$ $ft^3=2.6\times10^{12}$ BTU.

The energy required to heat the reservoir via a steam driven recovery process can also be estimated. The oil sands comprising the bitumen typically contain 10% water, 25% bitum and 65% sand grains by volume. The steam driven recovery process operates under a reservoir temperature of 300° F. The enthalpies for steam at 300° F. and water at 70° F. are 1180 and 38 BTU/lb, respectively. The heat capacities for bitumen and sand are 0.60 and 0.19 BTU/lb/° F. Thus, the energy required to heat the reservoir can be estimated as:

Water=$0.1\times62$ $lb/ft^3\times2.2\times10^6$ $ft^3\times(1180-38)$ BTU/lb=$1.6\times10^{10}$ BTU.

Bitumen=$0.25\times62$ $lb/ft^3\times2.2\times10^6$ $ft^3\times0.6$ BTU/lb/° F.×(300−70)° F.=$4.3\times10^9$ BTU.

Sand=$0.65\times164$ $lb/ft^3\times2.2\times10^6$ $ft^3\times0.19$ BTU/lb/° F.×(300−70)° F.=$1.0\times10^{10}$ BTU.

So the total energy is $3.0\times10^{10}$ BTU, which is only about 1.2% of the total heat content of the in-place bitumen.

For a recovery process involving combustion, the reservoir is assumed to operate at a temperature of about 550° C., which is about 1000° F. So the extra energy required for the combustion process over the steam process is approximately:

$$(0.1\times1.0\times62+0.25\times0.6\times62+0.65\times0.19\times164)\times2.2\times10^6\times(1000-300)=5.5\times10^{10}\text{ BTU}$$

So the total energy required for the combustible fluid process is $8.5\times10^{10}$ BTU. Overall, a safe estimate of the energy required for a recovery process with steam or combustion is $1.0\times10^{11}$ BTU, or about 4% of the energy of the bitumen in the reservoir.

The cost of fabricating the permeable zones 13 can also be estimated. The energy required to fabricate a zone 13 for a 2.5-acre 5-spot well pattern by a high-power microwave method is estimated to be less than about 1% of the energy of the in-place bitumen. As oil sands having bitumen are typically fairly shallow and the unconsolidated sands are easy to drill, the costs of forming a zone 13 via mechanical drilling or high pressure water jet is not expected to exceed 2.5% of the energy of the in-place bitumen. Thus, the process of flowing steam or combustion through a permeable zone 13 in the reservoir is expected to be a highly cost-effective and efficient means of bitumen recovery.

The above description and examples show an improved method and well configuration for the recovery of dense hydrocarbons, such as bitumen, from a subterranean reservoir 11, by providing a highly permeable zone 13 having a patterned web of channels radiating out from and connecting injection and production wells 21, 31. The highly permeable zone 13 provides better heating of the hydrocarbons in the reservoir 11 by forming an extended heating area adjacent to and beneath portions of the reservoir 11 to quickly and efficiently heat a larger volume of the reservoir 11. Furthermore, a patterned grid 42 of wells can be provided having interconnecting permeable zones 13 with convoluted flow paths and spaced apart "open" and closed regions to control the flow of the fluids to areas in the reservoir 11 to maximize the recovery of hydrocarbons from the reservoir 11. Because the cost and energy of fabricating the permeable zone 13 and performing the recovery process is expected to be a small percentage of the overall value and energy content of the hydrocarbons in the reservoir 11, the permeable zone 13 is expected to provide a highly cost-effective and energy efficient means of recovering the hydrocarbons from the reservoir 11.

Although exemplary embodiments of the present invention are shown and described, those of ordinary skill in the art may devise other embodiments which incorporate the present invention, and which are also within the scope of the present invention. For example, other versions of web patterns can be used depending upon terrain, topography, and the viscosity of the hydrocarbon deposits. Therefore, the appended claims should not be limited to the descriptions of the preferred versions, materials, or spatial arrangements described herein to illustrate the invention.

What is claimed is:

1. A method of recovering hydrocarbons from a subterranean reservoir, the method comprising:

(a) drilling an injection well bore into the subterranean reservoir, the injection well bore having an outlet;

(b) drilling a production well bore into the subterranean reservoir, the production well bore being spaced apart from the injection well bore and having an inlet;

(c) forming a permeable zone comprising a first patterned web of channels radiating outwardly from the outlet of the injection well bore and connecting to a second patterned web of channels radiating outwardly from the inlet of the production well bore in the subterranean reservoir; and (d) flowing a heated fluid from the outlet of the injection well bore and into the permeable zone to mobilize hydrocarbons in the subterranean reservoir so that the mobilized hydrocarbons flow toward the inlet of the production well bore.

2. A method according to claim 1 wherein (c) comprises forming a permeable zone having a predetermined shape that induces gravity drainage of the mobilized hydrocarbon towards the inlet of the production well bore.

3. A method according to claim 1 wherein (c) comprises forming the permeable zone about a plane that is angled downwardly from the injection well bore to the production well bore.

4. A method according to claim 3 wherein (c) comprises forming a permeable zone that is angled downwardly with an angle of from about 5 degrees to about 20 degrees.

5. A method according to claim 1 wherein (c) comprises forming a permeable zone having first and second patterned webs of channels that fan out from the injection and production well bores towards an interior region of the reservoir between the injection and production well bore, and wherein the first and second patterned web of channels are connected at the interior region.

6. A method according to claim 1 wherein (c) comprises forming a permeable zone that fans out from at least one of the injection and production well bores at a horizontal angle of from about 30 degrees to about 60 degrees.

7. A method according to claim 1 wherein (c) comprises forming a permeable zone having a convoluted path between the injection well bore and production well bore.

8. A method according to claim 1 comprising forming a plurality of injection well bores and production well bores that are disposed about the intersection points of a grid pattern.

9. A method according to claim 1 comprising forming two injection well bores and two production well bores that are disposed at the vertices of a square, the injection well bores lying on a first diagonal and the production well bores lying on a second diagonal of the square, and further comprising forming permeable zones that pass through an interior region of the square to connect outlets and inlets of the injection and production well bores.

10. A method according to claim 1 wherein (d) comprises flowing a heated fluid comprising an oxygen-containing gas into the permeable zone.

11. A method of recovering hydrocarbons from a subterranean reservoir, the method comprising:

(a) drilling injection and production well bores into the subterranean reservoir so that alternating injection and production well bores are disposed at intersection points of a grid pattern, the grid pattern comprising squares with diagonally facing injection wells bores and diagonally facing production wells bores, wherein the injection well bores comprise outlets and the production well bores comprise inlets;

(b) forming a plurality of permeable zones, the permeable zones comprising a first patterned web of channels that radiate outwardly from facing pairs of outlets of the injection well bores in the subterranean reservoir and a second atterned web of channels that radiate outwardly from facing pairs of inlets of the production well bores; and (c) flowing a heated fluid from the outlets into the permeable zones to fluidize hydrocarbons in the subterranean reservoir so that the fluidized hydrocarbons flow toward the inlets of the production well bores.

12. A method according to claim 11 wherein in (b) the permeable zones are spaced apart from one another in the grid pattern by unexcavated reservoir regions.

13. A method according to claim 11 wherein in (b) the permeable zones comprise triangular sections that fan out with increasing width from each well bore.

14. A method according to claim 13 wherein in (b) each triangular section covers an angle of from about 30 to about 60 degrees.

15. A method according to claim 14 wherein diagonally opposing triangular sections abut together along a base of each triangle about a center of the square.

16. A method according to claim 11 wherein (c) comprises flowing a heated fluid compnsing an oxygen-containing gas into the permeable zones.

17. A method of recovering hydrocarbons from a subterranean reservoir, the method comprising:

(a) drilling an injection well bore and a production well bore into the subterranean reservoir, the injection well bore having an outlet spaced apart from an inlet of the production well bore;

(b) forming a permeable zone comprising (i) a first patterned web of channels radiating outwardly from the outlet of the injection well bore, the channels extending downwardly into the subterranean reservoir at an angle of at least about 5 degrees, and (ii) a second patterned web of channels radiating outwardly from the inlet of the production well bore and located below, or connected to, the first patterned web of channels; and (c) flowing a heated fluid into the permeable zone to mobilize hydrocarbons in the subterranean reservoir so that the mobilized hydrocarbons flow toward the inlet of the production well bore.

18. A method according to claim 17 wherein (b) comprises forming a permeable zone that fans out from the injection well bore at a horizontal angle of from about 30 degrees to about 60 degrees.

19. A well pattern to recover hydrocarbons from a subterranean reservoir, the well pattern compnsing:

an injection well bore extending into the subterranean reservoir, the injection well bore comprising an outlet;

an injection fluid supply to supply a heated fluid to the subterranean reservoir via the outlet;

a production well extending into the subterranean reservoir, the production well being spaced apart from the injection well bore and having a inlet; and a permeable zone in the subterranean reservoir comprising a first patterned web of channels radiating outwardly from the outlet of the injection well bore and below or connected to a second patterned web of channels radiating outwardly from the inlet of the production well in the reservoir, whereby the heated fluid flows from the outlet into the permeable zone to mobilize hydrocarbons in the subterranean reservoir so that the mobilized hydrocarbons flow toward the inlet of the production well.

20. A well pattern according to claim 19 wherein the permeable zone is angled downwardly from the injection well bore to the production well at an angle of from about 5 degrees to about 20 degrees.

21. A well pattern according to claim 19 wherein the permeable zone fans out from at least one of the injection well bore and production well at an angle of from about 30 degrees to about 60 degrees.

22. A well pattern according to claim 19 wherein the permeable zone has a convoluted path between the injection well bore end production well.

* * * * *